United States Patent [19]

Kuhlman

[11] 4,087,977

[45] May 9, 1978

[54] DOCK SYSTEM

[75] Inventor: Tom Evan Kuhlman, Spirit Lake, Iowa

[73] Assignee: Docks Unlimited, Spirit Lake, Iowa

[21] Appl. No.: 780,595

[22] Filed: Mar. 24, 1977

[51] Int. Cl.[2] ..... E02B 3/20

[52] U.S. Cl. ..... 61/48; 24/73 HH; 108/83; 182/179; 248/214

[58] Field of Search ..... 61/48; 52/478, 489, 52/486; 108/83, 89, 90; 248/214, 215; 182/119, 179; 24/73 HH

[56] References Cited

U.S. PATENT DOCUMENTS

| | | | |
|---|---|---|---|
| 2,599,670 | 6/1952 | Thomas | 182/179 X |
| 3,094,848 | 6/1963 | Albrecht | 61/48 |
| 3,396,817 | 8/1968 | Perry | 182/179 |
| 3,490,393 | 1/1970 | Nelson | 182/119 X |
| 3,509,966 | 5/1970 | Sarno | 182/119 |
| 3,953,980 | 5/1976 | Bennett | 61/48 |

*Primary Examiner*—Jacob Shapiro
*Attorney, Agent, or Firm*—Zarley, McKee, Thomte, Voorhees & Sease

[57] ABSTRACT

A boat dock of improved stability and ease of assembly and disassembly, which comprises a dock frame, a pair of dock legs for detachable securement to the opposing sides of the dock frame, and for each dock leg, a releasable leg holding bracket which has means for detachable securement of the bracket to the dock frame in order to prevent significant sidesway of the dock frame. The bracket is slidably received upon the dock legs and capable of upward sliding movement but has stop means to prevent downward sliding movement. The dock, because of its means of construction, prevents lateral swaying movement. Upward pulling motion caused by high waves may move the dock upward on the leg posts and as it comes down, this motion is used to further drive the leg posts into the lake bottom for increased stability.

9 Claims, 14 Drawing Figures

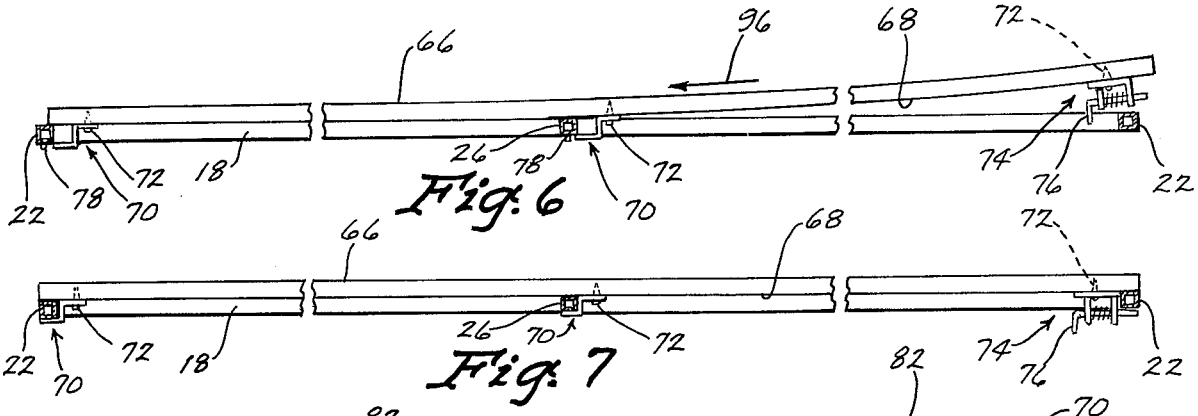
Fig. 6
Fig. 7
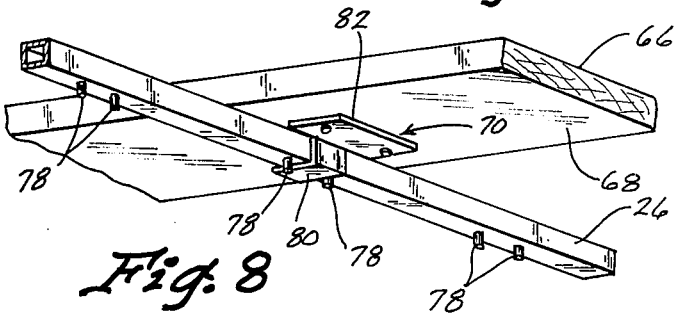
Fig. 8
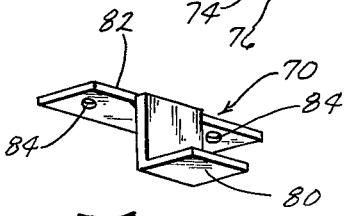
Fig. 9
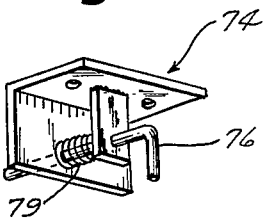
Fig. 10
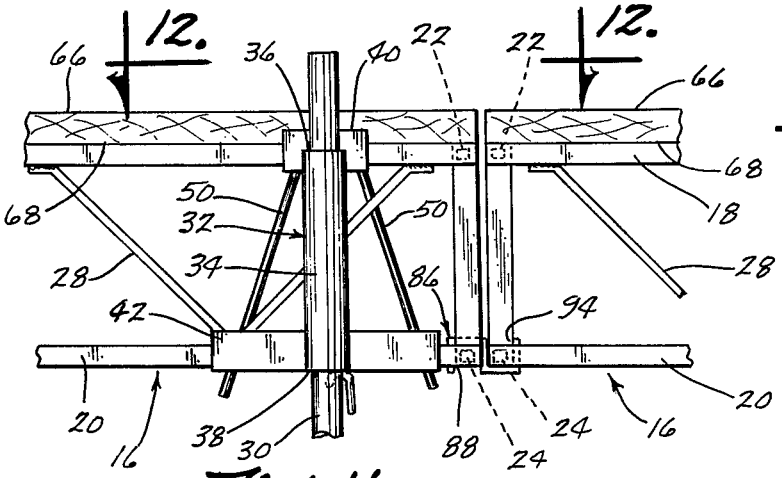
Fig. 11
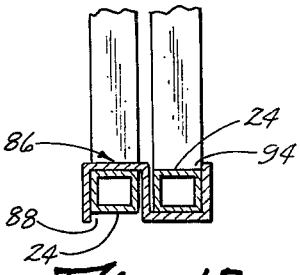
Fig. 13
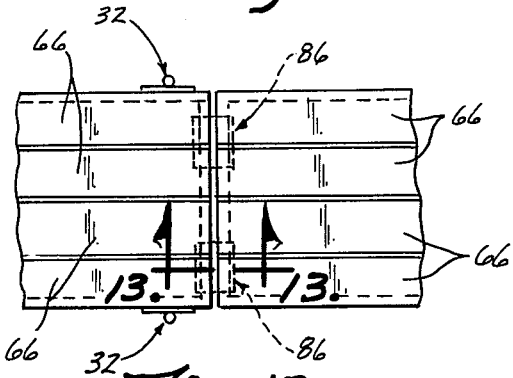
Fig. 12
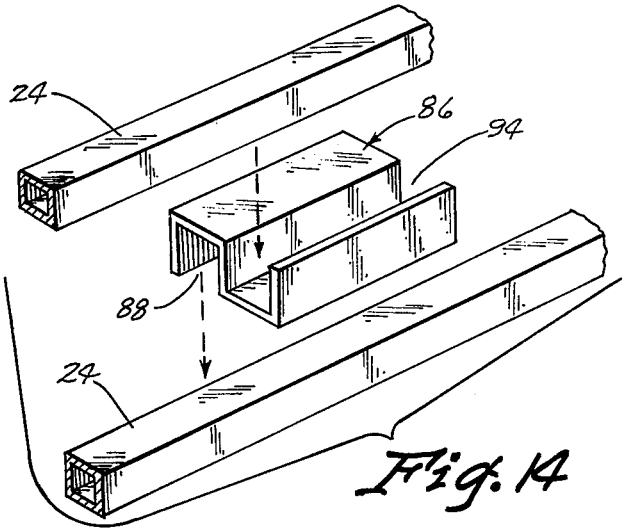
Fig. 14

DOCK SYSTEM

BACKGROUND OF THE INVENTION

In many areas of the country, such as the Midwest, upper Midwest and Northeastern part of the country, most of the fresh water lakes are used for recreational purposes in conjuction with lake access docks. Because the fresh water lakes will freeze over in the Fall, the docks must be removed from the lake after the summer recreation season and before freezing in the Fall. It is therefore essential that the dock be removable from the lake.

Heretofore, it has often proved difficult to design a dock system which has stability during the use season and yet is capable of easy installation and disassembly. Ease of assembly and ease of disassembly are important for obvious reasons as heretofore mentioned.

Stability of the dock system is important during its usage. Typically stability is measured by the resistance to lateral displacement of the dock planks as well as lateral displacement of the entire dock. In addition, stability is measured by the tendency of the dock for vertical displacement to disorient the dock from a level position. During use, lateral displacement is often caused by the pressures exerted on the dock by people walking back and forth during dock usage, as well as using the dock as leverage when either climbing into or out of the water. Vertical displacement often occurs during periods of high waves wherein the waves actually slap up against the bottom surface of the dock, causing upward displacement with the result being that the dock leg posts are pulled upwardly out of their secured position to the lake bottom.

Other disadvantages of many dock systems presently in use involve the fact that the moisture continually subjected to the dock frame often causes rusting of parts together which makes assembly and subsequent disassembly very difficult. Thus, dock systems which employ locking set screws or the like are often very unsatisfactory, in that the screws become rusted making removel difficult if not impossible.

Another potential problem area for dock systems involves the attaching means of planks to the top portion of the dock frame. A good dock must be attached by means which allows the upper plank surface to be entirely free from mechanical fastening means and yet must provide a plank support surface which is stable and yet easily removable for winter storage.

This invention has as its objects, the building of a dock system which satisfies all of the above needs. In particular, the dock system is of improved stability in that it involves means for preventing significant lateral movement of the dock when in use, it involves means for detachably but securely fastening planks to the dock frame, it involves a dock which can be conveniently and easily leveled, as well as a dock which will not be vertically upwardly pulled from the water by the impact of waves on the under surface of the dock.

In addition to all the above advantages, the dock system of this invention is conveniently and easily assembled in the spring and disassembled in the fall. Moreover, the dock system of this invention avoids the use of locking set screws which have the potential of being frozen into position by rusting, making removal difficult if not impossible. Finally, the dock system of this invention allows for a means of connection of one dock frame section with another at any portion along the dock frame in order to build a dock of any desired configuration.

The dock system which accomplishes each of the above described advantages, as well as other advantages, will become apparent from the detailed description of the invention which follows below.

SUMMARY OF THE INVENTION

A boat dock of improved stability and ease of assembly which comprises a dock frame having an upper surface adapted for releasable attachment of dock planks, the dock frame being supported by at least a pair of dock legs positioned in the water for detachable securement to the opposing sides of the dock frame, each leg having associated therewith a releasable leg holding bracket for detachable securement to the frame in a manner which prevents significant sidesway of the dock frame, and which is attachable to each leg in slidable fashion to allow upward sliding movement of the bracket of the dock legs, but which is prevented from downward sliding movement by a stop means on the leg poles. Impact caused by waves on the bottom surface of the dock will move the dock upwardly and when the wave impact is over, the dock will slam downwardly on the dock leg further driving it into its anchored position and thereby causing increased stability of the leg posts as anchored to the lake bottom.

BRIEF DESCRIPTION OF THE DRAWINGS

FIG. 6 is an elevated side view showing a plank in position for attachment to the dock frame.

FIG. 7 is an elevated side view, like FIG. 6, which shows the plank attached to the dock frame.

FIG. 8 is an underside view of a plank as attached to the dock frame, showing how lateral displacement of the plank is prevented.

FIG. 9 is an elevated perspective view of an L-shaped one-way plank attaching bracket.

FIG. 10 is an elevated perspective view of a one-way spring pin bracket.

FIG. 11 is an elevated side view showing two dock frame assemblies attached to each other.

FIG. 12 is a plan view along line 12—12 of FIG. 11.

FIG. 13 is a sectional view along line 13—13 of FIG. 12.

FIG. 14 is a perspective view showing the double U connecting bracket and its manner of use in attaching one frame section to another frame section.

DETAILED DESCRIPTION OF THE INVENTION

Figure 1:
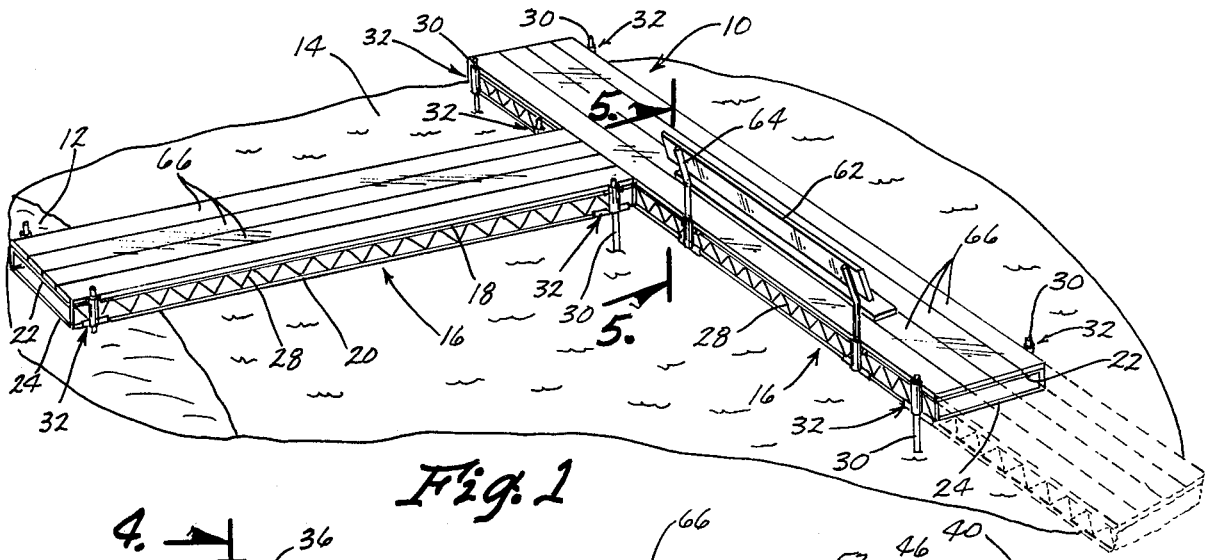
FIG. 1 is a perspective view of the assembled dock of this invention.

Looking first at FIG. 1, a dock, depicted generally as 10, is attached at its shore side 12 to the ground and projects outwardly into the lake 14. The dock is comprised of a plurality of dock frame sections, depicted generally at 16, which may be attached one to another, in a manner hereinafter described, to form a dock of any desired shape or length.

Each dock frame section 16 is typically 4 foot wide, and 10 or 20 foot in length. Each section is comprised of upper and lower side bars, 18 and 20, with the side bars being joined at their respective ends by 46 inches wide upper and lower end bars 22 and 24. Positioned intermediate the ends of dock frame 16, and not specifically depicted in FIG. 1, but shown in FIG. 8, are intermediately positioned reinforcing cross bars 26. Of course, if desired, a plurality of reinforcing intermediate cross bars 26 may extend from upper side bar 18 on one side of dock frame 16, to the corresponding upper side bar on the opposite side of dock frame 16. As depicted in FIG. 1, dock frame 16 also has reinforcing rods 28 welded in the fashion shown in FIG. 1, extending between upper side bar 18 and lower side bar 20. Also, each frame has vertical end support base 23.

Dock 20, is supported, in a manner hereinafter described in detail, in its position in lake 14 on dock legs 30.

Figure 2:
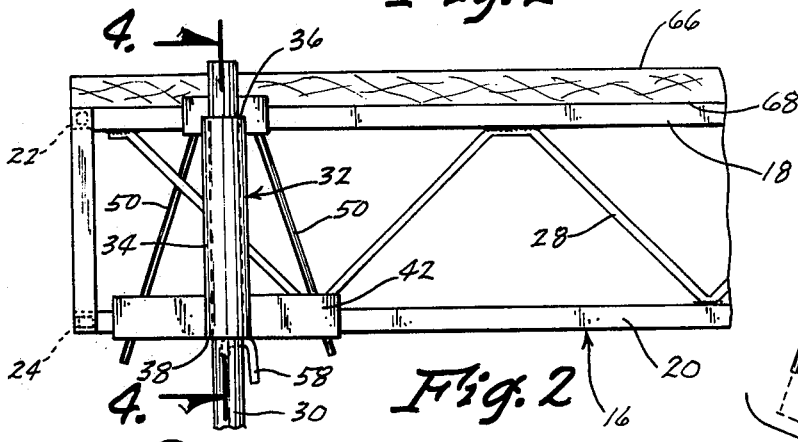
FIG. 2 is an elevational side view showing one side of the post, or leg, attaching bracket.
Figure 3:
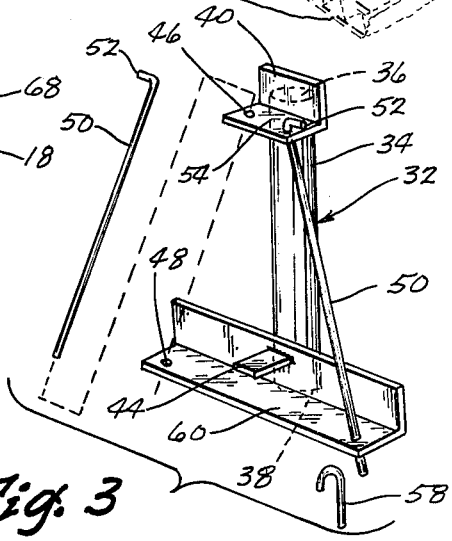
FIG. 3 is a perspective view showing the side of the post bracket opposite the side shown in FIG. 2.
Figure 5:
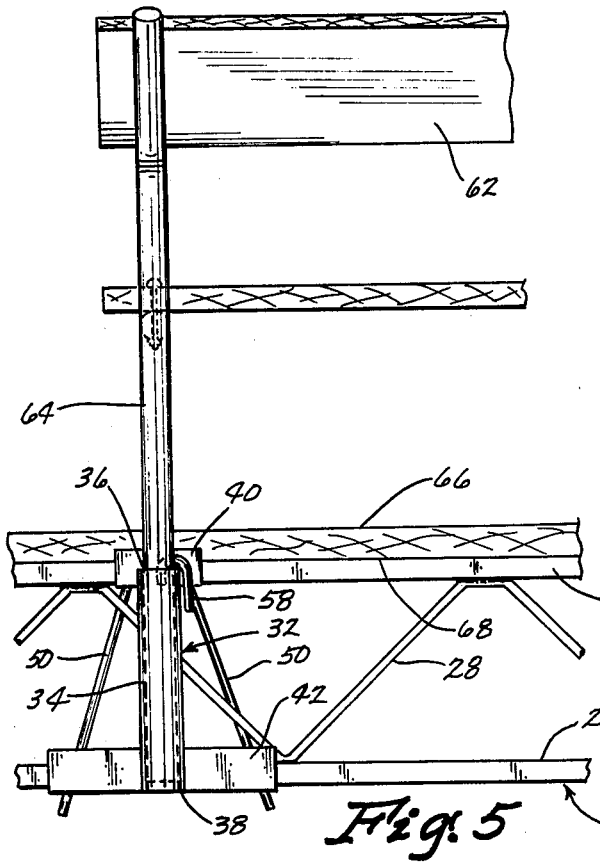
FIG. 5 is a view of the dock shown in FIG. 1 as seen along line 5—5 which shows in detail the attachment of a dock seat.
Figure 4:
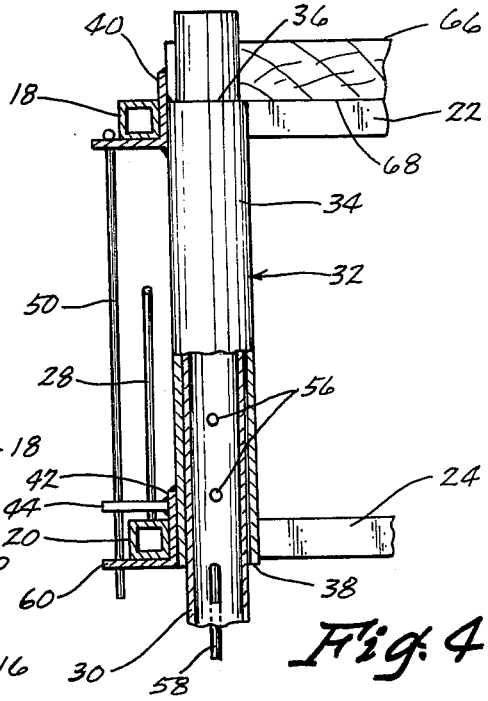
FIG. 4 is a sectional view along line 4—4 of FIG. 2.

Dock legs 30 are attached to the sides of dock frame 16 via leg holding brackets 32 which are shown in detail in FIGS. 2 and 3.

Leg holding brackets 32 are comprised of a leg receiving sleeve 34 having an open top end 36 and an open bottom end 38. Attached to leg sleeve 34 near its open top end 36 is L-bracket 40. Likewise, attached to leg sleeve 34 near its open bottom end 38 is a corresponding longer L-bracket 42. Tab 44 is also attached to L-bracket 42 and projects inwardly as depicted in FIG. 3. L-brackets 40 and 42 both have their open side projecting inwardly as depicted in FIG. 3. The base of L-bracket 40 has two pin receiving apertures 46 and in like fashion longer L-bracket 42 has pin receiving apertures 48. Hook pins 50 may be extended through apertures 46 and through aperture 48 with the hook 52 engaging the base 54 of upper L-bracket 40.

The leg posts 30 have a plurality of spaced apart apertures 56 extending along the length of leg post 30. Leg post bracket 32 is attached to the dock frame section 16 in the following manner. Leg sleeve 34 is positioned over leg 30 and lowered to its desired position. Lock pin 58 is placed in aperture 56 and acts as a stop to prevent downward slidable movement of bracket 32. Upper side bar 18 rests in abutting relationship against the base 54 of L-bracket 40. In similar manner, lower side bar 20 rests against the base 60 of L-bracket 42. Tab 44 assures that any upward movement of dock frame 16 will also cause upward movement of leg holding bracket 32. Hook pins 50 are inserted as depicted in FIG. 3 through apertures 46 and apertures 48 locking upper and lower side bars 18 and 20 to leg bracket 32 in a manner which prevents lateral movement of dock frame 16 away from leg holding brackets 32.

As can be seen, when the leg holding brackets 32 are attached to the dock frame 16, as previously described herein, upward impact caused on the under surface of the dock frame 16 may cause upward sliding movement of leg sleeve 34 on leg post 30 since any upward movement caused to dock frame 16 will be transferred to the leg post via tab 44. However, if the dock is lifted upwardly by the impact of waves against its bottom surface, when the dock moves downwardly, it will engage stop pin 58 and act as a hammer causing leg pole 30 to be driven further into the bottom of lake 14, even further and more securely anchoring leg pole 30 thereto. Lateral displacement of dock frame 16 is prevented by locking pins 50.

As can be seen, dock chair 62 is anchored via chair support posts 64 inserted in the open top end 36 of a pair of leg supports attached in the manner previously described. Lock pins 58 are used to engage the open top edge of leg sleeve 34 at 36 to fixedly position chair 52 in place.

Planks 66 are attached to the dock frame 16 as depicted in detail in FIGS. 6, 7, and 8. The lower surface of plank 68 has positioned at one end and in an intermediate position, one way L-brackets 70. L-brackets 70 are attached to the under surface of plank 66 via lag screws 72.

Also positioned on the under surface of planks 66 at the other end, is a one way spring pin bracket 74. As seen in FIGS. 6 and 7, the opening of spring pin bracket 74 is in a direction opposing the opening direction of one way L-shaped brackets 70. Brackets 70 and 74 are positioned on plank 66 so that bracket 72 can be slid into engagement with upper end bar 22 and intermediate bracket of like construction can engage intermediate reinforcing cross-bar 26. Plank 66 is then bowed as depicted in 68 and pin 76 is drawn back, and plank 68 moved downwardly into the position of FIG. 7. Pin 76 is then released and urged into the position shown in FIG. 7 via biasing spring 78. In this manner plank 68 is locked into position on the upper surface of dock frame 16. Displacement along the longitudinal axis of plank 66 is prevented by use of two one-way L-shaped brackets 70 positioned with their open end in the same direction and by use of a spring bracket 74 with its opening position in a direction opposite to the L-shaped opening of bracket 70. Lateral displacement transverse to the longitudinal axis of plank 66 is prevented by downwardly projecting tabs 78 which are spaced apart a sufficient width such that they just engage the base portion 80 of one-way brackets 70. Thus, planks 66 are held in position and both longitudinal and lateral displacement is prevented. Plate 82, as previously mentioned, and lag screws 72 which extend through the apertures 84 in plate 82 are used to hook one way brackets 70 to the under surface of 68 of planks 66.

As seen in FIGS. 11, 12 and 13, a plurality of frame sections 16 may be hooked together at any convenient point. This is accomplished by use of double U-shaped connecting bracket 86. As shown in FIG. 11, one opening 88 of double U-bracket 86 is locked over a bar 20 (see FIG. 14), with another bar 20 of a second dock frame section 16 resting in the other U-shaped opening 94. In this manner, as depicted in FIG. 11, two frame sections may be locked one to the other, either in an end to end relationship or in a corner intersection as depicted in FIG. 1. In actual practice, it has been found desirable to also lock the upper frame bars in position via an additional locking bracket secured through apertures in said bars which are not specifically depicted herein.

Thus, as can be seen, the invention accomplishes at least all of its stated objectives. The system is easily disassembled by simply withdrawing pins 76 and upwardly moving planks 66 to the position of FIG. 6 at which point it can be withdrawn in a direction opposite arrow 96. After the planks are removed, pins 52 can be withdrawn and the dock frame 16 can be removed, and thereafter leg brackets 36 conveniently removed, and finally the posts 30 removed. Assembly, of course, is in the reverse direction. In addition, the dock is uniquely stable, side to side swaying movement is prevented, and the planks are prevented from both longitudinal and lateral displacement. The dock itself is firmly anchored and it is prevented from being displaced upwardly by the impact of waves on its under surface since brackets 30 are upwardly slidable on leg posts 30. Moreover, the downward impact is transferred to leg poles 30 in order to more securely anchor those into the bottom surface. No screws are utilized for fastening means, and therefore the interfering action of rusting is prevented.

I claim:

1. A boat dock of improved stability and ease of assembly for mounting in a body of water having a bottom, said dock comprising:

a dock frame having an upper surface, opposite side frames, and end frames extending between said side frames;

at least one dock plank supported on said upper surface of said dock frames;

at least a pair of dock legs positioned on opposite sides of said dock frame, each of said legs having its lower end anchored in said bottom of said body of water;

a leg holding bracket mounted for vertical sliding movement on each of said dock legs, said bracket comprising a sleeve having upper and lower sleeve ends and being slidably received upon said leg, said bracket further comprising detachable mounting means for detachably mounting said bracket to said dock frame, stop means on said leg below said sleeve for engaging said lower sleeve end and limiting downward sliding movement of said sleeve beyond a predetermined point with respect to said leg, said bracket being free for upward sliding movement on said leg in response to upward forces on said bracket and said dock frame.

2. A boat dock according to claim 1 wherein said side frames each include elongated upper and lower horizontal members, said mounting means comprising an upper bracket member fixed to said sleeve and retentively engaging said upper horizontal member, and a lower bracket member fixed to said sleeve and retentively engaging said lower horizontal member.

3. A boat dock according to claim 2 wherein said mounting means further comprise at least one hook pin extending through apertures in said upper and lower brackets to detachably lock said sleeve to said dock frame.

4. The device of claim 1 wherein said stop means is a pin releasably extendable into said dock legs.

5. The boat dock of claim 1 wherein said dock frame has at least one reinforcement cross bar extending between said dock sides.

6. The boat dock of claim 5 wherein said reinforcement bar has means thereon to prevent significant lateral movement of said dock planks.

7. The boat dock of claim 1 wherein said dock frame is adapted for attaching a plurality of frame sections together.

8. The boat dock of claim 7 wherein said frame sections are attached by a removable double U-bracket.

9. A boat dock of improved stability and ease of assembly for mounting in a body of water having a bottom, said dock comprising:

a dock frame having an upper surface, opposite side frames, and end frames extending between said side frames, at least one dock plank supported on said upper surface of said dock frame;

at least a pair of vertical dock legs positioned on opposite sides of said dock frame;

a leg holding bracket for each of said dock legs, said bracket comprising a sleeve having upper and lower sleeve ends and being slidably received upon said leg for vertical sliding movement thereon;

mounting means operatively attaching said bracket to said dock frame;

stop means on said leg below said sleeve for engaging said sleeve and limiting downward sliding movement of said sleeve on said leg beyond a predetermined point;

said bracket being free for upward sliding movement on said leg;

at least one reinforcement cross bar extending between said side frames, means attached to the bottom surface of said plank for securing said plank to said dock frame comprising a first one way slide bracket attached near one end of said plank, a second one way slide bracket attached to said plank at an intermediate position, and a spring biased pin lock one way clamp attached to said plank at the other end of said plank, said pin lock being oriented for sliding engagement with said dock frame in the opposite direction of said first and second way sliding brackets.

* * * * *